US005633126A

United States Patent [19]

Dickerson et al.

[11] Patent Number: 5,633,126

[45] Date of Patent: May 27, 1997

[54] FILMS FOR REPRODUCING DIGITALLY STORED MEDICAL DIAGNOSTIC IMAGES AND INTEGRATING NON-IMAGE INFORMATION

[75] Inventors: Robert E. Dickerson, Hamlin; Mridula Nair, Penfield; George L. Oltean, Rochester; Lloyd A. Lobo, Webster, all of N.Y.

[73] Assignee: Eastman Kodak Company, Rochester, N.Y.

[21] Appl. No.: 574,509

[22] Filed: Dec. 19, 1995

[51] Int. Cl.[6] ..... G03C 1/76; G03C 1/005

[52] U.S. Cl. ..... 430/496; 430/567; 430/140; 430/944; 430/966; 430/523

[58] Field of Search ..... 430/966, 567, 430/944, 496, 140, 523

[56] References Cited

U.S. PATENT DOCUMENTS

| | | | |
|---|---|---|---|
| 4,665,004 | 5/1987 | Drexler | 430/140 |
| 4,801,523 | 1/1989 | Tufano | 430/589 |
| 5,252,441 | 10/1993 | James et al. | 430/496 |
| 5,260,178 | 11/1993 | Harada et al. | 430/508 |
| 5,420,001 | 5/1995 | Ito et al. | 430/567 |

OTHER PUBLICATIONS

*Research Disclosure,* vol. 365, Sep. 1994, Item 36544.

*Primary Examiner*—Mark F. Huff
*Attorney, Agent, or Firm*—Carl O. Thomas

[57] ABSTRACT

A radiation-sensitive silver halide film for reproducing digitally stored medical diagnostic images through a series of laterally offset exposures by a controlled radiation source followed by processing in 90 seconds or less, including development, fixing and drying. The film exhibits an average contrast in the range of from 1.5 to 2.0, measured over a density above fog of from 0.25 to 2.0. An emulsion layer is provided in which silver bromochloride grains (a) comprised of at least 10 mole percent bromide, based on silver, (b) having a mean equivalent circular diameter of less than 0.40 μm, (c) exhibiting an average aspect ratio of less than 1.3, and (d) coated at a silver coverage of less than 40 $mg/dm^2$. Adsorbed to the surfaces of the silver bromochloride grains at least one spectral sensitizing dye having an absorption half peak bandwidth in the spectral region of exposure by the controlled exposure source. The film contains an infrared opacifying dye that is capable of reducing specular transmission through the film before, during and after processing to less than 50 percent, measured at a wavelength within the spectral region of from 850 to 1100 nm. The film contains a magnetic recording layer which provides a positive b* value influence that is more than offset by the negative b* value influence of the silver bromochloride emulsion, allowing magnetic recording layer integration into the film while achieving favorable image tone and minimum density characteristics.

10 Claims, No Drawings

FILMS FOR REPRODUCING DIGITALLY STORED MEDICAL DIAGNOSTIC IMAGES AND INTEGRATING NON-IMAGE INFORMATION

FIELD OF THE INVENTION

The invention is directed to silver halide containing films for reproducing digitally stored medical diagnostic images.

DEFINITION OF TERMS

In referring to grains or emulsions containing two or more halides, the halides are named in order of ascending concentrations.

The "aspect ratio" of a grain is the ratio of its equivalent circular diameter (ECD) to its thickness. The ECD of a grain is the diameter of a circle having an area equal to the projected area of the grain.

The "coefficient of variation" (COV) of grain size (ECD) is defined as 100 times the standard deviation of grain size divided by mean grain size.

The term "covering power" is used to indicate 100 times maximum density divided by silver coating coverage measured in $g/dm^2$.

The term "cold" in referring to image tone is used to mean an image tone that has a CIELAB b* value measured at a density of 1.0 above minimum density that is −6.5 or more negative. Measurement technique is described by Billmeyer and Saltzman, Principles of Color Technology, 2nd Ed., Wiley, New York, 1981, at Chapter 3. The b* values describe the yellowness vs. blueness of an image with more positive values indicating a tendency toward greater yellowness.

The term "rapid access processor" is employed to indicate a radiographic film processor that is capable of providing dry-to-dry processing in 90 seconds or less. The term "dry-to-dry" is used to indicate the processing cycle that occurs between the time a dry, imagewise exposed element enters a processor to the time it emerges, developed, fixed and dry.

The term "average contrast" is employed to indicate contrast measured over the density range of from 0.25 to 2.0 above fog. Contrast is, of course, the ratio of $\Delta D+\Delta \log E$, where D is density and E is exposure in lux-seconds.

The term "high intensity reciprocity failure" (HIRF) is employed to indicate a progressive reduction in speeds observed at equal exposures within the range of exposure times of from $10^{-1}$ to $10^{-9}$ second.

The "half peak absorption bandwidth" of a dye is the spectral range in nm over which it exhibits a level of absorption equal to at least half of its peak absorption ($\lambda_{max}$).

The term "thiaalkylene bis(quaternary ammonium) salt" is employed to describe salts containing two ammonio groups joined through a thiaalkylene linkage. Ammonio groups are those that contain at least one of the following quaternary nitrogen atoms:

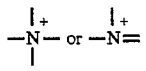

A "thiaalkylene" linkage is an alkylene linkage including at least one divalent sulfur atom replacing a carbon.

*Research Disclosure* is published by Kenneth Mason Publications, Ltd., Dudley House, 12 North St., Emsworth, Hampshire P010 7DQ, England.

BACKGROUND

Roentgen discovered X-radiation by the inadvertent exposure of a silver halide photographic element. In 1913 the Eastman Kodak Company introduced its first product specifically intended to be exposed by X-radiation. Silver halide radiographic elements account for the overwhelming majority of medical diagnostic images.

The needs of medical diagnostic imaging have dictated the evolution of silver halide radiographic elements:

(1) The need to minimize patient exposure to X-radiation has led to the use of the high speed silver bromide and iodobromide emulsions.

(2) The need to verify quickly that appropriate images have been obtained for diagnostic purposes has led to the creation of films that are compatible with rapid access processors. Reductions in processing times to substantially less than 90 seconds are being vigorously pursued in the art at this time.

(3) The fact that silver cannot be reclaimed (as is customary in color photography, for instance) has led to film constructions that maximize silver covering power.

(4) The need to produce images for medical diagnoses that have similar and familiar qualities to aid the radiologist's diagnosis, including features, such as image tone, that go more to image appearance than actual information content.

In recent years a number of alternative approaches to medical diagnostic imaging, particularly image acquisition, have become prominent. Medical diagnostic devices such as storage phosphor screens, CAT scanners, magnetic resonance imagers (MRI), and ultrasound imagers allow information to be obtained and stored in digital form. Although digitally stored images can be viewed and manipulated on a cathode ray tube (CRT) monitor, a hard copy of the image is almost always needed.

The most common approach for creating a hard copy of a digitally stored image is to expose a radiation-sensitive silver halide film through a series of laterally offset exposures using a laser, a light emitting diode (LED) or a light bar (a linear series of independently addressable LED's). The image is recreated as a series of laterally offset pixels. Initially the radiation-sensitive silver halide films were essentially the same films used for radiographic imaging, except that finer silver halide grains were substituted to minimize noise (granularity). The advantages of using modified radiographic films to provide a hard copy of the digitally stored image are that medical imaging centers are already equipped to process radiographic films and are familiar with their image characteristics.

A typical film, Kodak Ektascan HN™, for creating a hard copy of a digitally stored medical diagnostic image includes an emulsion layer coated on a clear or blue tinted polyester film support. The emulsion layer contains a red-sensitized silver iodobromide (2.5M % I, based on Ag) cubic grain (0.33 μm ECD) emulsion coated at a silver coverage of 30 $mg/dm^2$. A conventional gelatin overcoat is coated over the emulsion layer. On the back side of the support a pelloid layer containing a red-absorbing antihalation dye is coated. A gelatin interlayer, used as a hardener incorporation site, overlies the pelloid layer, and a gelatin overcoat containing an antistat overlies the interlayer. Developed silver is relied upon to provide in the infrared density required to activate processor sensors. No dye is introduced for the purpose of increasing infrared absorption.

It is the prevailing practice to process radiographic films and the film described above in 90 seconds or less. For example, the Kodak X-OMAT 480 RA™ rapid access processor employs the following processing cycle:

| | |
|---|---|
| Development | 24 seconds at 35° C. |
| Fixing | 20 seconds at 35° C. |
| Washing | 20 seconds at 35° C. |
| Drying | 20 seconds at 65° C. |

with up to 6 seconds being taken up in film transport between processing steps.

A typical developer (hereinafter referred to as Developer A) exhibits the following composition:

| | |
|---|---|
| Hydroquinone | 30 g |
| Phenidone ™ | 1.5 g |
| KOH | 21 g |
| $NaHCO_3$ | 7.5 g |
| $K_2SO_3$ | 44.2 g |
| $Na_2S_2O_3$ | 12.6 g |
| NaBr | 35.0 g |
| 5-Methylbenzotriazole | 0.06 g |
| Glutaraldehyde | 4.9 g |
| Water to 1 liter/pH 10.0 | |

A typical fixer exhibits the following composition:

| | |
|---|---|
| Sodium thiosulfate, 60% | 260.0 g |
| Sodium bisulfite | 180.0 g |
| Boric acid | 25.0 g |
| Acetic acid | 10.0 g |
| Water to 1 liter/pH 3.9–4.5 | |

Radiographic film processors such as RA 480 are capable of exposing large amounts of film over extended periods of time (e.g., a month or more) before its processing solutions are drained and replaced. Extended use of the processing solutions is made possible by the addition of small amounts of developer and fixer replenishers as each film is processed to compensate for developer and fixer losses by evaporation and film pick up.

Magnetic recording materials for incorporation in photographic elements are disclosed in *Research Disclosure*, Vol. 365, September 1994, Item 36544, Section XIV. Scan facilitating features, paragraph (2).

RELATED PATENT APPLICATIONS

Nair et at U.S. Ser. No. 08/604,272, filed Feb. 21, 1996, commonly assigned, titled PHOTOGRAPHIC ELEMENTS CONTAINING A TRANSPARENT MAGNETIC RECORDING LAYER, discloses a photographic sheet element comprising a film support, coated on one side of the support a first hydrophilic colloid layer unit having a thickness $T_E$ and including a silver halide emulsion layer, coated on the opposite side of the support a second hydrophilic colloid layer unit including a transparent magnetic recording layer comprising ferromagnetic particles in a hydrophilic colloid, the thickness of the transparent magnetic recording layer being $T_M$, and, coated between the support and the transparent magnetic recording layer a hydrophilic colloid pelloid layer, the thickness of the pelloid layer being $T_C$. The relative thickness of the layers being represented by the formula: $(T_C+T_M)+T_E=>0$ and $<10$.

Dickerson et al U.S. Ser. No. 08/574,508, filed concurrently herewith and commonly assigned, discloses a radiation-sensitive film for reproducing digitally stored medical diagnostic images through a series of laterally offset exposures by a controlled radiation source followed by processing in 90 seconds or less including development, fixing and drying is disclosed. The film exhibits an average contrast in the range of from 1.5 to 2.0, measured over a density above fog of from 0.25 to 2.0. An emulsion is provided in which silver bromochloride grains provided (a) containing at least 10 mole percent bromide, based on silver, (b) having a mean equivalent circular diameter of less than 0.40 μm, (c) exhibiting an average aspect ratio of less than 1.3, and (d) coated at a silver coverage of less than 40 $mg/dm^2$. Adsorbed to the surfaces of the silver bromochloride grains is at least one spectral sensitizing dye having an absorption half peak bandwidth in the spectral region of exposure by the controlled exposure source. The film also contains an infrared opacifying dye capable of reducing specular transmission through the film before, during and after processing to less than 50 percent, measured at a wavelength within the spectral region of from 850 to 1100 nm.

SUMMARY OF THE INVENTION

It is an object of this invention to provide a film for reproducing digitally stored medical diagnostic images that is capable of additionally providing non-image information in a separate record. It is a specific discovery of this invention that acceptably cold image tones can be retained while employing a magnetic recording layer for providing non-image information. The advantages of incorporating in a film non-image information is that this avoids the liability of keeping a separate record correlated with the film. For example, if information on the acquisition or processing of a film cannot be correlated to a film image, the value of the image is either compromised or lost entirely. At present a radiologist will often read a film and simultaneously describe the critical features of the image on which a medical diagnosis is based. The present invention by integrating a non-image record with the image bearing film allows the medical diagnosis to be integrated with the film, thereby essentially eliminating the burden of correlation and the risk of inadvertent separation or loss of the film interpretation.

One of the surprising features of the invention is that it has been possible to integrate a magnetic recording layer (known to impart warm image tones) for providing a non-image information record while still retaining a relatively cold image tone, consistent with the image tones of medical diagnostic radiographic films. A conventional practice is to incorporate a blue dye in a film (usually the support) to shift image tone to colder values. Unfortunately, the blue dye addition increases the neutral minimum density of the film. As the film is constructed of components that produce progressively warmer image tones compensation with blue dye becomes progressively less feasible, since the minimum density of the film is being degraded. Hence, the present invention allows relatively colder image tones to be achieved without dye incorporation and allows cold image tones to be realized with minimal blue dye incorporation.

It is an additional discovery of the invention that elements employing less than 40 $mg/dm^2$ silver can be constructed to satisfy image tone requirements while also allowing more rapid processing and retaining compatibility with rapid access processor sensors that depend on sensing infrared density to control the processor.

The films of the invention consume lower amounts of developer than the films now in use commercially. This allows the operators of rapid access processing equipment to reduce the amount of replenisher used during processing and/or to increase the interval between developer solution replacement. This translates into less spent processing solution requiring disposal and less rapid access processor down time for servicing.

In one aspect the invention is directed to a radiation-sensitive silver halide film for reproducing digitally stored medical diagnostic images through a series of laterally offset exposures by a controlled radiation source followed by processing in 90 seconds or less, including development, fixing and drying, comprised of a transparent film support having front and back major faces, a front hydrophilic colloid layer unit containing an emulsion layer coated on the front face of the support, and a back hydrophilic colloid layer unit coated on the back face of the support, wherein (A) the film exhibits an average contrast in the range of from 1.5 to 2.0, measured over a density above fog of from 0.25 to 2.0, (B) the emulsion layer (1) contains silver bromochloride grains (a) comprised of at least 10 mole percent bromide, based on silver, (b) having a mean equivalent circular diameter of less than 0.40 μm, (c) exhibiting an average aspect ratio of less than 1.3, and (d) coated at a silver coverage of less than 40 mg/dm$^2$, and (2) has adsorbed to the surfaces of the silver bromochloride grains at least one spectral sensitizing dye having an absorption half peak bandwidth in the spectral region of exposure by the controlled exposure source, (C) the back hydrophilic colloid layer unit contains a magnetic recording layer, and (D) the film contains an infrared opacifying dye that is capable of reducing specular transmission through the film before, during and after processing to less than 50 percent, measured at a wavelength within the spectral region of from 850 to 1100 nm.

DESCRIPTION OF PREFERRED EMBODIMENTS

A typical film satisfying the requirements of the invention exhibits the following structure:

| |
|---|
| SURFACE OVERCOAT (SOC-1) |
| INTERLAYER (IL-1) |
| EMULSION LAYER (EL) |
| SUBBING LAYER (SL) |
| TRANSPARENT FILM (TF) |
| SUBBING LAYER (SL) |
| PELLOID (PL) |
| MAGNETIC RECORDING LAYER (MRL) |
| SURFACE OVERCOAT (SOC-2) |
| (I) |

SL and TF together form a transparent film support. While a support in its simplest form can consist of any flexible transparent film, it is common practice to modify the surfaces of photographic and radiographic film supports by providing subbing layers to promote the adhesion of hydrophilic colloids to the support. Although any conventional photographic film support can be employed, it is preferred to employ a radiographic film support, since this maximizes compatibility with the rapid access radiographic film processors in which the films of the invention are intended to be processed and provides a radiographic film look and feel to the processed film. Radiographic film supports usually exhibit these specific features: (1) the film support is constructed of polyesters to maximize dimensional integrity rather than employing cellulose acetate supports as are most commonly employed in photographic elements and (2) the film supports are blue tinted to contribute the cold (blue-black) image tone sought in the fully processed films, whereas photographic films rarely, if ever, employ blue tinted supports. Radiographic film supports, including the incorporated blue dyes that contribute to cold image tones, are described in *Research Disclosure*, Item 18431, cited above, Section XII. Film Supports. *Research Disclosure*, Vol. 365, September 1994, Item 36544, Section XV. Supports, illustrates in paragraph (2) suitable subbing layers to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly (ethylene naphthenate) are specifically preferred polyester film supports.

SOC-1, IL-1 and EL together form a first processing solution permeable layer unit. PL, MRL and SOC-2 together form a second processing solution permeable layer unit. Of all the layers in both layer units only the emulsion layer EL and the magnetic recording layer MRL are essential to the practice of the invention. One function of the second layer unit is to balance the forces exerted by the first layer unit that would otherwise cause the film to curl. The ratio of hydrophilic colloid in the first and second units is in all instances $\leqq 0.1$ and $<100$, preferably from $\geqq 0.2$ to $\leqq 1.0$, optimally from $\geqq 0.67$ to $\leqq 0.8$. The anticurl function is primarily performed by the pelloid layer PL. The pelloid also provides a convenient site for dyes that are not required to interact with the emulsion layer EL. For example the pelloid layer is a preferred location for an antihalation dye. The other layers are provided to enhance the physical handling characteristics of the element and to provide convenient sites for modifying addenda.

In the simple, illustrative form shown film I contains a single emulsion layer EL. The emulsion grains have been chosen to offer a particularly advantageous combination of properties:

(1) Rapid processing, allowing compatibility with rapid access processors (including those having dry-to-dry processing in less than 40 seconds) used for radiographic films;

(2) High covering power, allowing low silver coating coverages; and (3) Enhanced image tone properties—that is, lower b* values when coated in films lacking blue dye incorporation and cold image tones with lower minimum densities when coated in films containing blue dye.

These properties are in part achieved by choosing emulsions containing silver bromochloride grains. Since the emulsions are intended to be exposed by a controlled radiation source, typically a laser, a slight increase in imaging speed that might be gained by iodide incorporation offers little or no practical benefit and is, in fact, a significant disadvantage when the reduction of development and fixing rates produced by iodide incorporation are taken into consideration. Iodide also contributes to warmer image tone. Thus, the grains as contemplated for use are substantially free of iodide.

The grains contain at least 50 mole percent chloride. It is known that silver chloride exhibits a higher level of solubility than other photographic halides and hence the fastest development and fixing rates. While this might suggest the use of pure silver chloride emulsions in the invention, this silver halide selection is not contemplated, since pure silver chloride emulsions have been observed to exhibit much lower covering power than the silver bromide and iodobromide emulsions conventionally employed in radiographic elements.

It has been discovered that, if at least about 10 mole percent bromide, based on total silver, is incorporated into the emulsion grains, covering power is increased to approximately the higher covering power levels of silver bromide, most commonly used in radiographic films. The grains preferably contain from about 20 to 40 mole percent bromide, based on total silver contained in the grains.

Bromide incorporated in the grains to increase covering power also shifts image tones; however, the emulsions retain the slightly negative b* values that are customarily sought for radiographic element images.

In addition to selecting the halide composition of the grains, the size of the grains is limited to increase the rate at which processing can occur. Specifically, it is contemplated to limit the average ECD of the grains to less than 0.40 μm. Preferably the emulsions are fine grain emulsions having mean grain ECD's in the range of from about 0.1 to 0.4 μm. For such fine grain emulsions nontabular grain populations are preferred. The average aspect ratio of a cubic grain emulsion is about 1.1. In the emulsions of the invention average aspect ratios of less than 1.3 are contemplated. The nontabular grains can take any convenient conventional shape consistent with the stated average aspect ratio. The grains can take regular shapes, such as cubic, octahedral or cubo-octahedral (i.e., tetradecahedral) grains, or the grains can other shapes attributable to ripening, twinning, screw dislocations, etc. Preferred grains are those bounded primarily by {100} crystal faces, since {100} grain faces are exceptionally stable.

The fine grain emulsions of the invention offer a relatively high ratio of surface area to grain volume and hence are particularly suited for rapid access processing. A common alternative approach for achieving high surface area to volume grain ratios is to employ a thin or high average aspect ratio tabular grain emulsion. A significant advantage of the fine grain emulsions contemplated for use over tabular grain emulsions and other larger grain size emulsions is that lower grain size dispersities are readily realized. Specifically, in the preferred emulsions of the invention the COV of the emulsions is less than 20 percent and, optimally, less than 10 percent.

Lower grain dispersities allow more efficient silver utilization in that a higher percentage of the total grain population can achieve near optimum sensitization. This in turn facilitates achieving optimum contrast ranges for digitally stored image reproduction. Blending of emulsions of different mean grain sizes can be used to fine tune contrast levels. It is specifically contemplated that the elements of the invention exhibit an average contrast in the range of from 1.5 to 2.0. Both the blending of emulsions and the coating of emulsions in separate superimposed layers are well known, as illustrated by *Research Disclosure*, Item 36544, I. Emulsion grains and their preparation, E. Blends, layers and performance categories, paragraphs (1), (2), (6) and (7).

The high covering power of the silver bromochloride grains allows coating coverages to be maintained at less than 40 (preferably less than 25) mg/dm$^2$, based on silver. Coating coverages for highly monodisperse emulsions as low as about 10 (preferably about 15) mg/dm$^2$ are contemplated.

The silver bromochloride emulsions can be selected from among conventional emulsions. A general description of silver halide emulsions can be found in *Research Disclosure*, Item 36544, I. Emulsion grains and their preparation. The most highly monodisperse (lowest COV) emulsions are those prepared by a batch double-jet precipitation process. It is noted that high (>50 mole percent) chloride emulsions containing minor amounts of bromide otherwise satisfying the grain requirements of this invention are commonly used for preparing photographic reflection prints. Specific examples of these emulsions are provided Hasebe et al U.S. Pat. No. 4,865,962, Suzumoto et al U.S. Pat. No. 5,252,454, and Oshima et al U.S. Pat. No. 5,252,456, the disclosures of which are here incorporated by reference. The silver bromochloride grains of conventional high chloride emulsions intended for graphic arts applications are also well suited for use in the present invention. Although reflection print and graphic arts emulsions overlap the bromide concentration ranges of this invention, less than optimum bromide levels for this invention are preferred for those applications; however, only routine adjustments during precipitation are needed to realize the preferred silver bromochloride compositions of this invention. Generally any convenient distribution bromide and chloride ions within the grains can be employed in the practice of the invention. It is generally preferred, based on convenience of preparation, to distribute bromide uniformly within the grains. Alternatively, silver bromide can be epitaxially deposited onto host grains containing lower levels of silver bromide (e.g., silver chloride host grains). The latter has the advantage of allowing the silver bromide epitaxy to act as a sensitizer.

In the course of grain precipitation one or more dopants (grain occlusions other than silver and halide) can be introduced to modify grain properties. For example, any of the various conventional dopants disclosed in *Research Disclosure*, Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by, Olm et al U.S. Pat. No. 5,360,712, the disclosure of which is here incorporated by reference. Dopants for increasing imaging speed by providing shallow electron trapping sites (i.e, SET dopants) are the specific subject matter of *Research Disclosure*, Vol. 367, November 1994, item 36736.

Since the controlled radiation sources used to reproduce digitally stored images frequently employ short ($<10^{-1}$ second) exposure times and laser exposures in fractional microseconds are common, it is specifically contemplated to reduce high intensity reciprocity failure (HIRF) by the incorporation of iridium as a dopant. To be effective for reciprocity improvement the Ir must be incorporated within the grain structure. To insure total incorporation it is preferred that Ir dopant introduction be complete by the time 99 percent of the total silver has been precipitated. For reciprocity improvement the Ir dopant can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations. The reason for this is that these dopants form deep electron traps and are capable of decreasing grain sensitivity if employed in relatively high concentrations. These non-SET Ir dopants are preferably incorporated in concentrations of at least $1\times10^{-9}$ mole per silver up to $1\times10^{-6}$ mole per silver mole. However, when the Ir dopant is in the form of a hexacoordination complex capable of additionally acting as a SET dopant, concentrations of up to about $5\times10^{-4}$ mole per silver, are contemplated. Specific illustrations of useful Ir dopants contemplated for reciprocity failure reduction are provided by B. H. Carroll, "Iridium Sensitization: A Literature Review", *Photographic Science and Engineering*, Vol. 24, No. 6 November/December 1980, pp. 265–267; Iwaosa et at U.S. Pat. No. 3,901,711; Grzeskowiak et al U.S. Pat. No. 4,828,962; Kim U.S. Pat. No. 4,997,751; Maekawa et al U.S. Pat. No. 5,134,060; Kawai et al U.S. Pat. No. 5,164,292; and Asami U.S. Pat. Nos. 5,166,044 and 5,204,234.

The contrast of the silver bromochloride emulsions can be increased by doping the with a hexacoordination complex containing a nitrosyl (NO) or thionitrosyl (NS) ligand. Preferred coordination complexes of this type are disclosed by McDugle et al U.S. Pat. No. 4,933,272, the disclosure of which is here incorporated by reference.

The contrast increasing dopants (hereinafter also referred to as NO or NS dopants) can be incorporated in the grain structure at any convenient location. However, if the NO or NS dopant is present at the surface of the grain, it can reduce the sensitivity of the grains. It is therefore preferred that the NO or NS dopants be located in the grain so that they are separated from the grain surface by at least 1 percent (most preferably at least 3 percent) of the total silver precipitated in forming the silver iodochloride grains. Preferred contrast enhancing concentrations of the NO or NS dopants range from $1\times10^{-11}$ to $4\times10^{-8}$ mole per silver mole, with specifically preferred concentrations being in the range from $10^{-10}$ to $10^{-8}$ mole per silver mole.

Combinations of Ir dopants and NO or NS dopants are specifically contemplated. Where the Ir dopant is not itself a SET dopant, it is specifically contemplated to employ non-SET Ir dopants in combination with SET dopants. Where a combination of SET, non-SET Ir and NO or NS dopants are employed, it is preferred to introduce the NO or NS dopant first during precipitation, followed by the SET dopant, followed by the non-SET Ir dopant.

After precipitation and before chemical sensitization the emulsions can be washed by any convenient conventional technique. Conventional washing techniques are disclosed by *Research Disclosure*, Item 36544, cited above, Section III. Emulsion washing.

The emulsions can be chemically sensitized by any convenient conventional technique. Such techniques are illustrated by *Research Disclosure*, Item 36544, IV. Chemical sensitization. Sulfur and gold sensitizations are specifically contemplated.

Since silver bromochloride emulsions possess little native sensitivity beyond the ultraviolet region of the spectrum and controlled radiation sources used for exposure, such as lasers and LED's, are most readily constructed to provide exposures in the longer wavelength portions of the visible spectrum (e.g., longer than 550 nm) as well as the near infrared, it is specifically contemplated that one or more spectral sensitizing dyes will be absorbed to the surfaces of the silver chlorobromide grains. Ideally the maximum absorption of the spectral sensitizing dye is matched (e.g., within ±10 nm) to the exposure wavelength of the controlled exposure source. In practice any spectral sensitizing dye can be employed which, as coated, exhibits a half peak absorption bandwidth that overlaps the spectral region of exposure by the controlled exposure source.

A wide variety of conventional spectral sensitizing dyes are known having absorption maxima extending throughout the visible and near infrared regions of the spectrum. Specific illustrations of conventional spectral sensitizing dyes is provided by *Research Diclsure*, Item 18431, Section X. Spectral Sensitization, and Item 36544, Section V. Spectral sensitization and desensitization, A. Sensitizing dyes.

Since solid-state controlled exposure sources tend to be more efficient at longer wavelengths of emission, it might seem most advantageous to sensitize the silver bromochloride grains to the near infrared region of the spectrum. Instead, the best matches of photographic and controlled exposure sources is found in the red region of the spectrum. In the wavelength range of from about 633 to 690 nm there are a variety of popular controlled exposure sources in widespread use, including helium-neon lasers. It is generally realized that as the peak absorption of spectral sensitizing dyes is shifted toward progressively longer wavelengths the propensity for dye-desensitization is increased. Dye-desensitization is inferred from the speed of an emulsion when sensitized to a particular wavelength is observed to be less than would be expected based on native sensitivity or sensitization with another dye with a similar or shorter maximum absorption wavelength. An abundance of spectral sensitizing dyes with low dye-desensitization characteristics with peak absorptions in the red region of the spectrum and controlled exposure sources with emissions in the red region of the spectrum renders this a preferred combination for most imaging applications. Of course, as better controlled exposure sources are developed emitting at shorter visible wavelengths are developed, the choice of preferred spectral sensitizing dyes will similarly shift.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 36544, Section VII. Antifoggants and stabilizers, and Item 18431, Section II. Emulsion Stabilizers, Antifoggants and Antikinking Agents.

The silver halide emulsion and other layers forming the processing solution permeable layer units on opposite sides of the support additionally contain conventional hydrophilic colloid vehicles (peptizers and binders), typically gelatin or a gelatin derivative. Conventional vehicles and related layer features are disclosed in *Research Disclosure*, Item 36544, II. Vehicles, vehicle extenders, vehicle-like addenda and vehicle related addenda. The emulsions themselves can contain peptizers of the type set out in II. above, paragraph A. Gelatin and hydrophilic colloid peptizers. The hydrophilic colloid peptizers are also useful as binders and hence are commonly present in much higher concentrations than required to perform the peptizing function alone. The vehicle extends also to materials that are not themselves useful as peptizers. Such materials are described in II. above, C. Other vehicle components.

The elements of the invention are fully forehardened to facilitate rapid access processing. The use of any convenient conventional hardener is contemplated. Such hardeners are described in II. above, B. Hardeners.

To facilitate rapid access processing it is contemplated to limit the vehicle coating coverages on each side of the support. To allow dry-to-dry processing in less than 90 seconds, each processing solution permeable layer unit must be fully forehardened and limited to a hydrophilic colloid coating coverage of less than 65 mg/dm$^2$, preferably less than 45 mg/dm$^2$. By fully forehardened it is meant that no additional hardening is required during processing.

The magnetic recording layer MRL can take the form of any conventional processing solution permeable magnetic recording layer. Such layer constructions are disclosed in

*Research Disclosure*, Vol. 343, November 1992, Item 34390. In addition to hydrophilic colloid the magnetic recording layer contains fine ferromagnetic powders, such as such as ferromagnetic γ-iron oxides, cobalt surface-treated ferromagnetic iron oxides, cobalt-doped ferromagnetic iron oxides, cobalt containing $Fe_2O_3$, ferromagnetic magnetites, cobalt-containing ferromagnetic magnetites, ferromagnetic chromium dioxides, ferromagnetic metal powders, ferromagnetic iron powders, ferromagnetic alloy powders and the class of ferromagnetic ferrite powders including barium ferrites. Additionally, the above mentioned powder particles may be modified to provide lower light extinction and scattering coefficients by providing them with a shell, of at least the same volume as the magnetic core, of a low refractive index material that has its refractive index lower than the transparent polymeric material used to form the magnetizable layer. Typical shell materials may include amorphous silica, vitreous silica, glass, calcium fluoride, magnesium fluoride, lithium fluoride, polytetrafluoroethelene and fluorinated resins. Examples of the ferromagnetic alloy powders include those comprising at least 75% by weight of metals which comprise at least 80% by weight of at least one ferromagnetic metal alloy (such as Fe, Co, Ni, Fe—Co, Fe—Ni, Co—Ni, Co—Ni—Fe) and 20% or less of other components (such as Al, Si, S, Sc, Ti, V, Cr, Fin, Cu, Zn, Y, Mo, Rh, Re, Pd, Ag, Sn, B, Ba, Ta, W, Au, Hg, Pb, La, Ce, Pr, Nd, Te, and Bi). The ferromagnetic metals can contain a small amount of water, a hydroxide or an oxide. In addition, magnetic oxides with a thicker layer of lower refractive index oxide or other material having a lower optical scattering cross section, such as taught by James et al U.S. Pat. No. 5,252,441, can also be used.

The dispersion preferably contains magnetic particles which are acicular or needle like magnetic particles. The average length of these particles along the major axis preferably is less than about 0.3, more preferably, less than about 0.2 μm. The particles preferably exhibit an axial ratio, that is, a length to diameter thickness ratio of up to about 5 or 6 to 1. Preferred particles have a specific surface area of at least 30 $m^2/g$, more preferably of at least 40 $m^2/g$. Typical acicular particles of this type include, for example, particles of ferri and ferro iron oxides such as γ-ferric oxide, complex oxides of iron and cobalt, various ferrites and metallic iron pigments. Alternatively, small tabular particles such as barium ferrites and the like can be employed. The particles can be doped with one or more ions of a polyvalent metal such as titanium, tin, cobalt, nickel, zinc, manganese, chromium, or the like as is known in the art.

A preferred particle consists of Co surface treated γ-$Fe_2O_3$ having a specific surface area of at least 40 $m^2/g$. Particles of this type are commercially available and can be obtained from Toda Kogyo Corporation under the trade names CSF 4085V2, CSF 4565V, CSF 4585V and CND 865V and are available on a production scale from Pfizer Pigments Inc. under the trade designations RPX-4392, RPX-5003, RPX-5026 and RPX-5012. For good magnetic recording, the magnetic particles preferably exhibit coercive force above about 500 Oe and saturation magnetization above 70 emu/g.

MRL can be prepared by initially forming a concentrated dispersion of the magnetic particles in water together with a dispersant, preferably one having an HLB number of at least 8, more preferably an amphipathic water-dispersible or soluble polymeric dispersant, and milling the resulting mixture in a device such as a ball mill, a roll mill, a high speed impeller mill, media mill, an attritor, a sand mill or the like as described in Nair et al U.S. Pat. No. 5,457,012, the disclosure of which is here incorporated by reference. Milling is continued for a sufficient time to ensure that substantially no agglomerates of the magnetic particles remain.

The length of milling time required depends on the particular milling device used. In general, milling should be continued from about 0.5 to about 8 hours, preferably from about 1 to about 4 hours.

The coating concentration of the magnetic particles in the magnetic recording layer can range from 0.1 to 10 $mg/dm^2$, preferably from about 0.2 to 0.7 $mg/dm^2$. The magnetic particles account for from 1 to 10 (preferably 2 to 5) percent of the total weight of the magnetic recording layer.

In addition to the magnetic particles and hydrophilic colloid it is additionally common practice to include in magnetic recording layers, singly or in combination, abrasive particles, reinforcing fillers and tin oxide.

Examples of abrasive and/or reinforcing filler particles include nonmagnetic inorganic powders with a Mohs scale hardness of not less than 6. Specific examples are metal oxides such as α-alumina, γ-alumina, chromium oxide (e.g., $Cr_2O_3$), iron oxide alpha (e.g., $Fe_2O_3$), silicon dioxide, alumino-silicate and titanium carbide; carbides such as silicon carbide and titanium carbide; nitrides such as, silicon nitride, titanium nitride and diamond in fine powder. Alpha alumina and silicon dioxide are the preferred abrasives in accordance with this invention. These can be pre-dispersed in water using the same dispersants as described in this invention and then incorporated into the coating composition.

Tin oxide particles in any form may be employed such as tin oxide per se or doped tin oxides, such as, antimony or indium doped tin oxide. The tin oxide may be used in either the conductive or nonconductive form; however, when in the conductive form, an additional advantage is gained in that the layer also acts as an antistat. Suitable conductive particles are disclosed in Kawaguchi et al U.S. Pat. Nos. 4,394,441 and 4,418,141, Yoshizumi U.S. Pat. No. 4,431,764, Takimoto et al U.S. Pat. No. 4,495,276, and Bishop et al U.S. Pat. No. 4,990,276, the disclosures of which are here incorporated by reference. Useful tin oxide particles are commercially available from Keeling and Walker, Ltd. under the trade designation Stanostat CPM 375; DuPont Co. under the trade designation Zelec-ECP 3005XC and 3010SC and Mitsubishi Metals Corp. under the trade designation T-1. Preferred metal antimonates include those having rutile or rutile-related crystallographic structures as those disclosed in Christian et al U.S. Pat. No. 5,368,995, the disclosure of which is here incorporated by reference. These can be also be pre-dispersed in water using the same dispersants as described in this invention and then incorporated into the coating composition.

The surface overcoats SOC-1 and SOC-2 are typically provided for physical protection of the emulsion and pelloid layers. In addition to vehicle features discussed above the overcoats can contain various addenda to modify the physical properties of the overcoats. Such addenda are illustrated by *Research Disclosure*, Item 36544, IX. Coating physical property modifying addenda, A. Coating aids, B. Plasticizers and lubricants, and D. Matting agents. The interlayer IL1 is typically a thin hydrophilic colloid layer that provides a separation between the emulsion and the surface overcoat addenda. It is quite common to locate surface overcoat addenda, particularly anti-matte particles, in this interlayer.

SOC-2, which overlies the MRL, comes into direct contact with the magnetic heads used for information transfer to and from the film. For best head performance it is specifically preferred to incorporate in SOC-2 a lubricant that will both minimize friction between the head and the film and resist transfer to the head. The incorporation of relatively immobile organic lubricants into SOC-2 has been found to be well suited for this purpose. By dispersing the lubricants in the hydrophilic colloid vehicle of the overcoat the overcoat remains processing solution permeable. Examples of suitable relatively immobile organic lubricants, sometimes referred to as waxes, include monobasic fatty acids having 10 to 40 carbon atoms (which may contain unsaturated bonds or may be branched) and metal salts thereof (such as Li, Na, K and Cu), monovalent, divalent, trivalent, tetravalent, pentavalent and hexavalent alcohols having 12 to 40 carbon atoms (which may contain unsaturated bonds or may be branched), alkoxy alcohols having 12 to 40 carbon atoms, mono-, di- and tri-esters of monobasic fatty acids having 10 to 40 carbon atoms (which may contain unsaturated bonds or may be branched) and one of monovalent, divalent, trivalent, tetravalent, pentavalent and hexavalent alcohols having 2 to 12 carbon atoms (which may contain unsaturated bonds or may be branched), fatty acid esters of monoalkyl ethers of alkylene oxide polymers, fatty acid amides having 8 to 40 carbon atoms and aliphatic amines having 8 to 40 carbon atoms. Specific examples of these compounds (i.e., alcohols, acids or esters) include carnauba wax, lauric acid, myristic acid, palmitic acid, stearic acid, behenic acid, butyl stearate, oleic acid, linoleic acid, linolenic acid, elaidic acid, octyl stearate, amyl stearate, isooctyl stearate, octyl myristate, butoxyethyl stearate, anhydrosorbitan monostearate, anhydrosorbitan distearate, anhydrosorbitan tristearate, pentaerythrityl tetrastearate, oleyl alcohol and lauryl alcohol.

The pelloid layer is a preferred location for antihalation dyes. Such dyes are illustrated by *Research Disclosure*, Item 36544, Section VIII. Absorbing and scattering materials, B. Absorbing materials. The antihalation dyes absorb light that has passed through the emulsion layer to minimize light reflection and the associated reduction in image sharpness. Antihalation dyes are chosen to be decolorized during processing. Alternatively, anithalation dye can be coated in a separate processing solution permeable layer, not shown in Element I, interposed between the support and the emulsion layer.

When the pelloid layer does not contain an antihalation dye, there is no need for processing solution to permeate PL, MRL and SOC-2. This allows higher levels of hardening to minimize solution ingestion during processing. Further, when processing solution permeation of these layers is not needed, a broader range of coating compositions, not limited to hydrophilic colloid vehicle coatings, are feasible in these layers.

Addenda to protect the elements from static discharge (i.e., antistats) can be incorporated in the elements of the invention at any convenient location. Antistats can be conveniently located in one or both of the surface overcoats. Antistats that are compatible with the magnetic recording particles, such as tin oxide, described above, can be located in the magnetic recording layer. One preferred location for antistat addenda is in a separate coating, not shown, interposed between the support and the pelloid. Antistats are particularly useful in protecting the elements from static discharge that can accumulate from repeated reading of information contained in the magnetic recording layer and/or high speed transport of the film. Conventional antistats useful in the elements of the invention are disclosed in *Research Disclosure*, Item 36544, IX. Coating physical property modifying addenda, C. Antistats. Any of the antistatic agents set forth in Sakakibara U.S. Pat. No. 5,147,768, here incorporated by reference, can be employed. Preferred antistats include metal oxides, for example, tin oxide, antimony doped tin oxide, vanadium pentoxide, and metal antimonates.

Although the silver chlorobromide emulsions described above provide an advantageous combination of properties, both the choice of bromochloride compositions and the limited silver coating coverages render the elements either incapable or only marginally capable of detection by the infrared (IR) sensors typically contained in rapid access processors. That is, the emulsion layer, before or after processing, is incapable of significantly attenuating IR radiation in the 850 to 1100 nm spectral region. Customarily when a radiographic film is placed in a rapid access processor the refractive indices mismatch of the silver halide grains and the vehicle is relied upon to scatter an IR sensor beam directed at the film. Silver bromochloride exhibits a lower refraction index than silver bromide or iodobromide. A beam attenuation of at least 50 percent provides a signal that a radiographic film has been placed in the processor. After the film has been processed, the developed silver in a conventional radiographic element is capable of providing the required 50 percent attentuation of another, exit IR sensor. When the exit sensor beam is no longer attenuated, this provides a signal to switch the processor to a shutoff or standby mode.

To render the element of the invention reliably detectable by conventional IR radiographic film entry and exit sensors in rapid access processors, it is contemplated to incorporate in the element of the invention an infrared opacifying dye capable of reducing specular transmission through the element before, during and after processing to less than 50 percent (preferably less than 25 percent), measured at a wavelength within the spectral region of from 850 to 1100 nm. For example, if the near IR sensors employ 920 nm lasers, the dye as incorporated in the cleaning element must reduce specular transmission through the cleaning element at 920 nm to less than 50 percent and, preferably, less than 25 percent. Since the sensor beam is limited to 920 nm wavelength radiation, the presence or absence of adsorption by the dye at other wavelengths is immaterial. The most efficient infrared opacifying dye choice would be a dye having a maximum absorption at (i.e., within ±10 nm) the wavelength of the sensor beams. Dyes having half peak absorption bandwidths that overlap the wavelength of the sensor beams are practically acceptable choices.

The infrared opacifying dye can be located within the element at any convenient location. It can be incorporated in the support (e.g., in the transparent film TF or in one or both of the subbing layers SL), coated on the support in any one or combination of the processing solution permeable layers. The preferred location for the infrared opacifying dye is in the pelloid layer PL.

When the infrared opacifying dye is added in one or more layers penetrated by processing solutions, the dye as coated must be water insoluble. Thus, for coating in this location infrared opacifying dyes are preferred that are water insoluble or that are capable of forming a water insoluble complex as coated. For example, the dye may form a water insoluble complex with gelatin. The dye can be added to hydrophilic colloid vehicle forming the layer in a water miscible solvent, such as methanol. Alternatively the dye can be added to the hydrophilic colloid in the form of solid dye particles. The maximum size of the dye particles is limited only by coating convenience. Preferably the dye particles have a mean size of less than 100 micrometers.

The infrared opacifying dyes can be selected from among conventional dyes known to exhibit a half peak bandwidth that is at least partially located within the spectral region of from 850 to 1100 nm. Water solubility can be reduced with little or no impact on absorption merely by altering the choice of substituents. Generally ionic substituents, such as acidic groups, increase water solubility while nonpolar and particularly higher molecular weight nonpolar substituents decrease water insolubility.

Dyes in the cyanine dye class are preferred infrared opacifying dyes. These dyes contain an odd number of methine (—CH=) or substituted methine groups linking two basic nuclei. The synthesis of dyes in the cyanine dye class having the required absorption in the 850 to 1100 nm range is particularly convenient, since the absorption of these dyes can be extended to longer wavelengths merely by increasing the number of methine groups linking the two basic nuclei. In preferred steric forms the dyes aggregate and exhibit bathochromically shifted absorptions. Generally absorption in the spectral region of from 850 to 1100 nm can be realized when 7, 9 or 11 methine groups link the basic nuclei of a cyanine dye. Such dyes are termed tricarbocyanine, tetracarbocyanine and pentacarbocyanine dyes, respectively. These methine linkages can be and are usually substituted. A very common substitution, often used to promote aggregation, is for the middle (meso) methine group to be substituted. In a preferred dye selection the meso methine group and the two adjacent methine groups form part of a 5 or 6 membered ring.

Tricarbocyanine, tetracarbocyanine and pentacarbocyanine dyes are illustrated by Simpson et al U.S. Pat. No. 4,619,892, Parton et al U.S. Pat. Nos. 4,871,656, 4,975,362, 5,061,618 and 5,108,882, Davies et al U.S. Pat. No. 4,988,615, Friedrich et al U.S. Pat. No. 5,009,992, Muenter et al U.S. Pat. No. 5,013,642, and Hamer *The Cyanine Dyes and Related Compounds*, Interscience, 1964, Chapters VIII and IX.

Particularly preferred infrared opacifying dyes are tricarbocyanine dyes satisfying the formula:

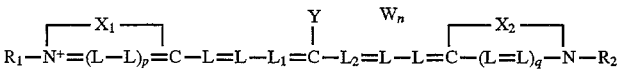

(II)

where $X_1$ and $X_2$ each independently represent the atoms necessary to complete a nucleus that with $(L—L)_p$ or $(L=L)_q$ form a 5 or 6-membered heterocyclic nucleus;

n, p and q each independently represents 0 or 1;

each L independently represents a methine group;

$L_1$ and $L_2$ are substituted methine groups that together form a 5- or 6-membered carbocyclic ring (that is, the methine carbon atoms are linked by 1,2-ethylene or 1,3-propylene groups);

$R_1$ and $R_2$ each independently represents an alkyl, sulfoalkyl or carboxyalkyl group (where the acid moieties can be present as a free acid, salt or ester);

Y represents an amino or sulfonyl group;

the alkyl moieties contain in each instance from 1 to 6 carbon atoms; and

W is a counterion to balance the charge of the molecule.

When Y is a sulfonyl group, it is preferably an $—SO_2R_3$ group, where $R_3$ is an aliphatic hydrocarbon or aromatic hydrocarbon containing from 1 to 10 carbon atoms. One or more heteroatoms (e.g., O, S, N) can be substituted for carbon in the aromatic hydrocarbon moieties. In a specifically preferred form $R_3$ is alkyl of from 1 to 6 carbon atoms.

When Y is an amino group, it can be a primary, secondary or tertiary amino group. Amino substituents when present can be independently selected from among alkyl and aryl substituents, typically each containing from 1 to 10 carbon atoms. Alternatively, when the amino is a tertiary amino substituent, the substituents can together with the amino nitrogen form a five or six membered heterocyclic ring. Piperidino and piperazino groups are preferred amino substituents.

Since the infrared opacifying dye remains a permanent part of the element, it must be free of any objectionable visible color. In general the opacifying dyes are chosen to be substantially colorless to the eye (e.g., to exhibit an optical density of less than 0.1 in the visible spectrum). However, opacifying dyes that appear blue can be employed, if desired, to replace the image tone controlling function of a conventional blue tinted support.

The following are illustrations of particularly preferred infrared opacifying dyes:

IROD-1 Anhydro-3,3'-bis(3-sulfobutyl)-10,12-ethylene-11-[4-(N,N-dimethylthiocarbamoyl)1-piperazino] thiatricarbocyanine triethylamine salt;

IROD-2 Anhydro-3,3'-bis(3-sulfobutyl)-10,12-ethylene-11-[4-(N,N-dimethylsulfamoyl)-1-piperazino] thiatricarbocyanine triethylamine salt;

IROD-3 Anhydro-3,3'-bis(3-sulfopropyl)-10,12-ethylene-11-piperidinothiatricarbocyanine triethylamine salt;

IROD-4 3,3'-Diethyl-10,12-ethylene-11-(4-methylpiperazino)thiatricarbocyanine perchlorate;

IROD-5 3,3'-Diethyl-10,12-ethylene-11-(2-methylpiperidino)thiatricarbocyanine perchlorate;

IROD-6 3,3'-Diethyl-10,12-ethylene-11-(2-methylpiperazino)benz[c]thiatricarbocyanine perchlorate;

IROD-7 3,3'-Diethyl-10,12-ethylene-11-diphenylaminothiatricarbocyanine perchlorate IROD-8 Anhydro-3,3'-bis(3-sulfopropyl)-10,12-ethylene-11-(N,N-diphenylamino)thiacarbocyanine hydroxide, triethylamine salt;

IROD-9 Anhydro-3,3'-bis(3-sulfopropyl)-10,12-ethylene-11-(N-methyl-N-phenylaminothiacarbocyanine hydroxide, triethylamine salt;

IROD-10 3,3'-Diethyl-10,12-ethylene-11-(N,N-diphenylamino)benz[c]thiacarbocyanine perchlorate;

IROD-11 Anhydro-3,3'-bis(3-sulfopropyl)-10,12-ethylene-11-(N,N-diphenylamino)benz[c]thiacarbocyanine hydroxide, triethylamine salt;

IROD-12 Anhydro-3,3'-bis(3-sulfopropyl)-10,12-ethylene-11-(N-methyl-N-phenylamino)benz[c]thiacarbocyanine hydroxide, triethylamine salt;

IROD-13 Anhydro-3,3'-bis(2-sulfoethyl)-12,14-propylene-13-methylsulfonyl-1,1,1',1'-tetramethylbenz[e] indolotricarbocyanine hydroxide, sodium salt;

IROD-14 Anhydro-3,3'-bis(3-sulfopropyl)-12,14-propylene-13-methylsulfonyl-1,1,1',1'-tetramethylbenz [e]indolotricarbocyanine hydroxide, sodium salt;

IROD-15 Anhydro-3,3'-bis(3-sulfobutyl)-13-methylsulfonyl-12,14-propylene-1,1,1',1'-tetramethylbenz[e]indolotricarbocyanine hydroxide, sodium salt;

IROD-16 Anhydro-3,3'-bis(3-sulfobutyl)-13-methylsulfonyl-12,14-propylene-1,1,1',1'-tetramethylbenz[e]indolotricarbocyanine hydroxide, sodium salt;

IROD-17 Anhydro-3,3'-bis(3-sulfopropyl)-12,14-ethylene-13-methylsulfonyl-1,1,1',1'-tetramethylbenz[e] indolotricarbocyanine hydroxide, sodium salt;

IROD-18 3,3'-Diethyl-11-ethylsulfo-10,12-propylenebenz [c]thiacarbocyanine perchlorate.

It has been discovered quite unexpectedly that an increase in imaging speed can be realized by incorporating a thiaalkylene bis(quaternary ammonium) salt in at least one of (1) a hydrophilic colloid layer unit of the film or (2) the developer (or activator) solution used during processing. The thiaalkylene bis(quaternary ammonium) salt acts as a development accelerator and hence its activity is dependent upon being present within the emulsion layer during development. When the thiaalkylene bis(quaternary ammonium) salt is incorporated in a developer or activator, a contemplated concentration of the development accelerator is in the range of from 0.1 to 1.0 g/L, preferably from 0.2 to 0.6 g/L.

A preferred location of the thiaalkylene bis(quaternary ammonium) salt is in the emulsion layer containing hydrophilic colloid layer unit. Processing solution permeates this entire layer unit during development and hence the thiaalkylene bis(quaternary ammonium) salt diffuses into the emulsion layer with the developer or activator solution, if it is not initially coated directly within the emulsion layer. Useful thiaalkylene bis(quaternary ammonium) salt concentrations in the hydrophilic colloid layer unit containing the emulsion layer are contemplated to range from 0.02 to 1.0 mg/dm$^2$, preferably from 0.05 to 0.60 mg/dm$^2$.

When the thiaalkylene bis(quaternary ammonium) salt is incorporated in a hydrophilic colloid layer unit on the back side of the support, it is necessary that the salt diffuse from the back side layer unit into the developer and then into the hydrophilic colloid layer unit containing the emulsion layer. In this instance somewhat higher concentrations are required than when the salt is incorporated directly in the emulsion layer containing hydrophilic colloid layer unit to achieve comparative effects.

In a preferred form the thiaalkylene bis(quaternary ammonium) salt satisfies the formula:

$$Q^1—[(CH_2)_n—S—]_m—(CH_2)_p—Q^2\ X \qquad \text{(III)}$$

where m is an integer of from 1 to 3, n and p are independently integers of from 1 to 6, $Q^1$ and $Q^2$ are ammonio groups, and X represents the ion or ions necessary to provide charge neutrality.

Typical ammonio groups include simple acyclic groups, such as illustrated by the formula:

$$\begin{array}{c} R^1 \\ | \\ R^2—\overset{+}{N}— \\ | \\ R^3 \end{array} \qquad \text{(IV)}$$

where $R^1$, $R^2$ and $R^3$ are independent hydrocarbon groups each containing from 1 to 10 (preferably 1 to 6) carbon atoms. To facilitate solubility and mobility in processing solutions it is preferred to limit the number of carbon atoms or to substitute the hydrocarbon atoms with polar substituents, such as carboxy, sulfonyl, carbamoyl, amido, sulfamoyl or sulfonamido groups. Preferred hydrocarbon groups are phenyl, alkylphenyl, phenylalkyl and alkyl groups. It is specifically preferred to limit the total number of carbon atoms in any one ammonio group to 10 or less.

In an alternative preferred form $R^1$ and $R^2$ can together complete a membered ring. Where $R^1$ and $R^2$ together form an alkylene group, typically the alkylene group contains from 4 to 10 carbon atoms. In most instances $R^1$ and $R^2$ are chosen to complete a 5 or 6 membered ring. For example, $R^1$ and $R^2$ can together complete an N-$R^3$-pyrrolio, N-$R^3$-pyrrolinio, N-$R^3$-pyrazinio, N-$R^3$-morpholinio, N-$^3$-piperidinio or N-$^3$-piperazinio ring.

It is specifically contemplated to employ ammonio groups illustrated by the following formula:

$$\begin{array}{c} | \\ R^4—\overset{+}{N}=R^5 \end{array} \qquad \text{(V)}$$

where $R^4$ and $R^5$ together complete a five or six membered ring. For example, the ammonio group can be an N-2H-pyrroleninio or N-pyridinio group.

In heterocyclic ammonio groups and particularly aromatic heterocylic ammonio groups it is not necessary that the point of attachment to the linking thiaalkylene group be at the site of the quaternized nitrogen atom. From example, ammonio groups such as 4-(N-methylpyrindinio) and N'-(N-methylpyrazinio) ammonio groups are specifically contemplated.

The charge balancing counterions can be chosen from any of the anions commonly found in silver halide emulsion layers, including halide ions (e.g., fluoride, chloride, bromide), hydroxide, phosphate, sulfate, nitrate, tetrafluoroborate, p-toluenesulfonate, and perchlorate. Anions compatible with silver halide emulsions can be used interchangeably without affecting the activity of the development accelerator.

The following are illustrations of specific thiaalkylene bis(quaternary ammonium) salts:

Q-1 N,N'-[1,8-(3,6-dithiaoctylene)]bis(1-methylpiperidinium) p-toluenesulfonate;

Q-2 N,N'-[1,10-(3,8-dithiadecylene)]bis(1-methylpiperidinium) p-toluenesulfonate;

Q-3 N,N'-[1,12-(3,10-dithiadodecylene)]bis(1-methylpiperidinium) p-toluenesulfonate;

Q-4 N,N'-[1,8-(3,6-dithiaoctylene)]bis(1-methylmorpholinium) p-toluenesulfonate;

Q-5 N,N'-[1,8-(3,6-dithiaoctylene)]bis (trimethylammonium) p-toluenesulfonate;

Q-6 N,N'-[1,8-(3,6-dithiaoctylene)]bis (diethylmethylammonium) p-toluenesulfonate;

Q-7 N,N'-[1,8-(3,6-dithiaoctylene)]bis(1,7-heptylenemethylammonium) p-toluenesulfonate;

Q-8 N,N'-[1,8-(3,6-dithiaoctylene)]bispyridinium tetrafluoroborate;

Q-9 N,N'-[1,8-(3,6-dithiaoctylene)]bis(4-dimethylaminopyridinium)bromide;

Q-10 N,N'-[1,8-(3,6-dithiaoctylene)]bis(3-formylpyridinium)bromide;

Q-11 N,N'-[1,8-(3,6-dithiaoctylene)]bis(4-methylpyridinium)bromide;

Q-12 N,N'-[1,8-(3,6-dithiaoctylene)]bis[3-(4-methylphenylsulfonamido)pyridinium]bromide;

Q-13 N,N'-[1,8-(3,6-dithiaoctylene)]bis[4-(5-nonyl) pyridinium)bromide;

Q-14 N,N'-[1,8-(3,6-dithiaoctylene)]bis(3-pentamido) pyridinium)bromide;

Q-15 N,N'-[1,8-(3,6-dithiaoctylene)]bis(3-propylcarbamoyl)pyridinium)bromide;

Q-16 N,N'-[1,8-(3,6-dithiaoctylene)]bis(1-methylmorpholinium) p-toluenesulfonate;

Q-17 N,N'-[1,13-(2,12-dihydroxy-3,6-dithiatridecylene)]bis (trimethylammonium) p-toluenesulfonate;

Q-18 N,N'-[1,13-(2,12-dihydroxy-3,6-dithiatridecylene)]bis (dibutylmethylammonium) p-toluenesulfonate;

Q-19 4,4'-[1,11-(3,6,9-trithiaundecyl)]bis(N-methylpyridinium) p-toluenesulfonate;

Q-20 N,N'-[1,11-(3,6,9-trithiaundecyl)]bis[4-(dimethylamino)pyridinium)bromide;

Q-21 4,4'-[1,8-(3,6-dithiaoctyl)]bis(N-methylpyridinium) perchlorate;

Q-22 2,2'-[1,8-(3,6-dithiaoctyl)]bis(N-methylpyridinium) perchlorate;

Q-23 N,N'-[1,19-(7,13-dithianonadecyl)]bis(2-methylpyridinium) p-toluenesulfonate;

Either or both of the hydrophilic colloid layer units coated on the front and back sides of the support, but most preferably the hydrophilic colloid layer unit containing the emulsion layer, can contain one or more developing agents. It is generally known that developing agents can be incorporated in a photographic or radiographic element and that development can be initiated by bringing the element into contact with an activator solution—that is, a solution otherwise similar to a developer, but lacking a developing agent. The problem that has previously been encountered in relying entirely on the element to supply the developing agent is that 1 equivalent of developing agent is required per mole of silver halide. Such large quantities of incorporated developing agent degrade the physical handling properties of a conventional element.

In the present invention the limited concentrations of silver (<40 mg/dm$^2$) allow proportionately lower developing agent concentrations and hence reduce the negative impact of incorporated developing agent on the physical handling properties of the elements of the invention. The use of a thiaalkylene bis(ammonium) salt of the type described above also allows the levels of incorporated developing agent to be reduced. It is also contemplated to employ, either incorporated in the film or in solution, a supplemental developing agent that is capable of reducing the incorporation of oxidized developing agent below 1 equivalent, preferably to 0.5 equivalent or less, and thereby allowing the restricted concentration developing agent to reduce larger amounts of silver halide than would be otherwise possible. When one or a combination of (a) lower silver coating coverages, (b) development accelerator incorporation, and (c) supplemental developing agent incorporation, it is possible to rely entirely on developing agent incorporated in the film for development and hence employ an activator solution instead of a developer processing.

It is additionally recognized that the incorporation of developing agent need not be at a sufficiently high level to replace completely developing agent in the developer. For example, one specifically contemplated function of incorporated developing agent can be to reduce the amount of developing agent that must be added to the developer in replenisher additions. Lowered concentrations of developing agent and, preferably, the supplemental developing agent, are contemplated both with and without development accelerator incorporation.

The incorporated developing agents and supplement developing agents can be of any conventional type, but are preferably of the types customarily used with rapid access processors. Preferred incorporated developing agents are hydroquinones. The following are illustrations of typical hydroquinone developers:

HQ-1 Hydroquinone;

HQ-2 Methylhydroquinone;

HQ-3 2,6-Dimethylhydroquinone;

HQ-4 Chlorohydroquinone;

HQ-5 2-Methyl-3-chlorohydroquinone;

HQ-6 Dichlorohydroquinone;

HQ-7 Bromohydroquinone;

HQ-9 Hydroxyhydroquinone;

HQ-10 Potassium hydroquinone sulfonate.

The supplemental developing agents are most typically p-aminophenols, p-phenylenediamines, reductones or 3-pyrazolidinones, with the latter being most widely used in rapid access processing. The following are specific illustrations of supplemental developing agents:

SDA-1 p-Aminophenol;

SDA-2 p-Methylaminophenol;

SDA-3 p-Ethylaminophenol;

SDA-4 p-Dimethylaminophenol;

SDA-5 p-Dibutylaminophenol;

SDA-6 p-Piperidinophenol;

SDA-7 4-Dimethylamino-2,6-dimethoxyphenol;

SDA-8 N-Methyl-p-phenylenediamine;

SDA-9 N-Ethyl-p-phenylenediamine;

SDA-10 N,N-Dimethyl-p-phenylenediamine;

SDA-11 N,N-Diethyl-p-phenylenediamine;

SDA-12 N,N,N',N'-Tetramethyl-p-phenylenediamine;

SDA-13 4-Diethylamino-2,6-dimethoxyaniline;

SDA-14 Piperidino-hexose-reductone;

SDA-15 Pyrrolidino-hexose-reductone;

SDA-16 1-Phenyl-3-pyrazolidinone;

SDA-17 4,4-Dimethyl-1-phenyl-3-pyrazolidinone;

SDA-18 4-Hydroxymethyl-4-methyl-1-phenyl-3-pyrazolidinone;

SDA-19 4,4-Bis(hydroxymethyl)-1-phenyl-3-pyrazolidinone;

SDA-20 4,4-Dimethyl-1-tolyl-3-pyrazolidinone;

SDA-21 4,4-Dimethyl-1-xylyl-3-pyrazolidinone;

SDA-22 1,5-Diphenyl-3-pyrazolidinone.

EXAMPLES

The invention can be better appreciated by reference to the following specific embodiments. All coating coverages, indicated parenthetically, are in mg/dm$^2$, except as otherwise indicated. Silver halide coating coverages are reported in terms of silver.

Example 1

Two elements of the layer arrangement of Element I, described above, were provided, but with differing silver halide grain compositions. The elements were constructed for exposure using a heliumneon 670 nm laser.

FILM SUPPORT

The film support was a conventional blue tinted 7 mil (177.8 mm) transparent poly(ethylene terephthalate) radiographic film support.

PELLOID

The pelloid contained gelatin (27.3) and the antihalation dyes bis[3-methyl-1-(p-sulfophenyl)-2-pyrazolin-5-one-(4)] pentamethineoxonol (0.96) and 1,4-benzene sulfonic acid, 2-[3-acetyl-4-{5-[3-acetyl-1-(2,5-disulfophenyl)-1,5-dihydro-5-oxo-4H-pyrazol-4-ylidene]-1,3-pentadienyl}-5-hydroxy-1H-pyrazol-1-yl]pentasodium salt (1.74).

SURFACE OVERCOAT SOC-1

The surface overcoat contained gelatin (4.5), matte beads (0.21), silicone lubricant (0.14) and surfactant.

INTERLAYER IL-1

The interlayer contained gelatin (4.5).

EMULSION LAYER

The emulsion layer contained an emulsion comprised of sulfur and gold sensitized silver halide cubic grains (25.1) having a mean ECD of 0.26 μm optimally spectrally sensitized with anhydro-9-ethyl-3,3'-bis(3-sulfopropyl)-4,5,4',5'-dibenzothiacarbocyanine hydroxide, sodium salt; gelatin (25.1); 4-hydroxy-6-methyl -2-methylmercapto-1,3,3A-tetraazaindene (3 g/Ag M); resorcinol (1.0) and sodium disulfocatechol (0.19). The silver halide compositions are set out in Table I below.

MAGNETIC RECORDING LAYER MRL

The magnetic recording layer contained gelatin (11.1), Sumitomo-AKP-50™ alumina abrasive(0.6), Toda CF-4085V2™ $Fe_2O_3$ (0.6), and polystyrene sulfonate, sodium salt (0.13).

SURFACE OVERCOAT SOC-2

The surface overcoat contained gelatin (0.82), carnuba wax (1.9) and polystyrene sulfonate, sodium salt (0.065).

All of the hydrophilic colloid layers were fully forehardened using 5.0 wt % bis(vinylsulfonylmethyl)ether, based on the weight of gelatin.

Two variations of the two elements above were constructed, but with the magnetic recording layer MRL and SOC-2 replaced with a gelatin interlayer identical to IL-1 and a conventional surface overcoat of the following composition: gelatin (4.5), matte beads (0.29), silicone lubricant (0.12), surfactant and the antistats lithium trifluoromethane (0.76) and Zonyl FSN™ (0.38), $F(CF_2CF_2)_{3-8}CH_2CH_2O—(CH_2CH_2O)_{8-12}H$.

Exposure and Processing

The elements were exposed using a helium-neon laser emitting at 670 nm. Processing was conducted using a Kodak X-OMAT M6A-N™ processor, using the processing cycle, developer and fixer, previously described in connection with processor Kodak X-OMAT 480 RA™.

TABLE I

| Silver Halide (mol. ratio) | MRL | Image Tone (b*) |
|---|---|---|
| $Br_{0.30}Cl_{0.70}$ | No | −12.6 |
| $I_{0.03}Br_{0.97}$ | No | −8.8 |
| $Br_{0.30}Cl_{0.70}$ | Yes | −11.6 |
| $I_{0.03}Br_{0.97}$ | Yes | −7.7 |

By comparing the b* value of a similar AgBrCl emulsion coated on a clear (no blue dye) support (see Example 2), it is estimated that the support itself contributed about −10 to the measured b* values. Thus, the AgBrCl emulsion itself actually provided a minus b* value contribution while the AgIBr emulsion provided a positive b* value contribution. The difference in b* values between the two emulsions was 3.8–3.9. This demonstrates that the AgBrCl emulsion allows for a significant reduction in the blue density of the support (and hence neutral minimum density) while providing a cold image. From Tables I and II it is estimated that with the magnetic recording layer present the blue dye could be reduced to an extent sufficient to allow its b* contribution to be less than −5.0 while still achieving a cold (−6.5 or more negative) b* value employing the AgBrCl emulsion. The colder image tone contribution of the AgBrCl emulsion more than offsets the contribution of the warmer image tone contribution of the magnetic recording layer. Hence, it is possible to accommodate a magnetic recording layer while achieving cold image tones or a better balance of colder image tones and lowered minimum densities.

Example 2

A series of elements of the layer arrangement of Element I, described above, but with MRL replaced with IL-2, were provided. Differing silver halide grain compositions were employed. The elements were constructed for exposure using a helium-neon 670 nm laser.

FILM SUPPORT

The film support was a conventional clear (not blue tinted) 7 mil (177.8 mm) transparent poly(ethylene terephthalate) radiographic film support.

PELLOID

The pelloid contained gelatin (25.1) and the antihalation dyes bis[3-methyl-1-(p-sulfophenyl)-2-pyrazolin-5-one-(4)] pentamethineoxonol (0.96) and 1,4-benzene sulfonic acid, 2-[3-acetyl-4-{5-[3-acetyl-1-(2,5-disulfophenyl)-1,5-dihydro-5-oxo-4H-pyrazol-4-ylidene]-1,3-pentadienyl}-5-hydroxy-1H-pyrazol-1-yl]pentasodium salt (1.74).

SURFACE OVERCOATS

The surface overcoats contained gelatin (4.5), matte beads (0.2) and silicone lubricant (0.14).

INTERLAYERS

The interlayers contained gelatin (4.5).

EMULSION LAYER

The emulsion layer contained an emulsion comprised of sulfur and gold sensitized silver halide cubic grains (20.2) optimally spectrally sensitized with anhydro-9-ethyl-3,3'-bis(3-sulfopropyl)-4,5,4,',5'-dibenzothiacarbocyanine hydroxide, sodium salt; gelation (21.8); 4-hydroxy-6-methyl-2-methylmercapto-1,3,3A-tetraazaindene (3 g/Ag M); resorcinol (1.0) and sodium disulfocatechol (0.2). Grain sizes and silver halide compositions are set out in Table I below.

All of the hydrophilic colloid layers were fully forehardened using 2.4 wt % bis(vinylsulfonylmethyl)ether, based on the weight of gelatin.

Exposure and Processing

The elements were exposed using a helium-neon laser emitting at 670 nm. Processing was conducted using a Kodak X-OMAT 480 RA™ processor, using the processing cycle, developer and fixer, previously described.

Observations of covering power, image tone (reported in terms by b* values), and fixing time are summarized in Table II. The fixing time was taken as the time required to lower residual silver to 1.1 mg/dm$^2$.

TABLE II

| Element | ECD (μm) | Silver Halide (mol. ratio) | Cov. Power | Image Tone (b*) | Fixing Time (sec.) |
|---|---|---|---|---|---|
| E1 | 0.23 | $Br_{0.30}Cl_{0.70}$ | 18 | −2.4 | 5.6 |
| E2 | 0.24 | $I_{0.03}Br_{0.97}$ | 16 | +1.7 | 17.7 |
| E3 | 0.23 | Br | 18 | +1.1 | 7 |
| E4 | 0.23 | Cl | 13 | −7.5 | 4 |

From Table II it is apparent that the coldest image tone and the fastest fixing time were realized by Element E4 containing a AgCl emulsion. Unfortunately, this emulsion exhibited the lowest covering power. E2 and E3 demonstrate the positions of AgIBr and AgBr emulsions, halide compositions that are commonly employed in radiographic elements. The AgIBr emulsion was clearly inferior in terms of covering power, image tone and fixing time as compared to the AgBr emulsion. The AgBr emulsion exhibited a higher covering power as compared to the AgCl and AgIBr emulsion, but was otherwise wise unremarkable, exhibiting a positive b* value image tone and a longer fixing time than the AgCl emulsion.

Taking all performance categories into account superior properties were realized by Element E1 employing the AgBrCl emulsion. The AgBrCl emulsion provided a relatively cold image tone and a low fixing time while covering power was equal to the highest observed level. To reach a cold image tone (b* −6.5 or more negative) less blue density is required in the support of an element employing a AgBrCl emulsion and hence a better relationship between image tone and minimum density can be realized.

Example 3

Variations of Elements 1E and 2E, described above, were constructed varying the coating coverages of the silver halide (stated in mg/dm$^2$ silver) and, in some elements, adding an infrared opacifying dye at varied coating coverages (stated in mg/dm$^2$) to the pelloid layer.

The percent of a 942 nm gallium arsenide laser beam attenuated by the various unprocessed elements is shown in Table III.

TABLE III

| Element | AgIBr | AgBrCl | IROD-1 | % Atten. |
|---|---|---|---|---|
| E5 | 0 | 0 | 0 | 11 |
| E6 | 2.7 | 0 | 0 | 23 |
| E7 | 5.4 | 0 | 0 | 32 |
| E8 | 10.9 | 0 | 0 | 47 |
| E9 | 21.8 | 0 | 0 | 59 |
| E10 | 0 | 2.7 | 0 | 15 |
| E11 | 0 | 5.4 | 0 | 18 |
| E12 | 0 | 10.9 | 0 | 21 |
| E13 | 0 | 21.8 | 0 | 23 |
| E14 | 0 | 10.9 | 0.11 | 25 |
| E15 | 0 | 10.9 | 0.22 | 42 |
| E16 | 0 | 10.9 | 0.44 | 69 |

From Table III it should be noticed that 21.8 mg/dm$^2$ AgIBr, a fully acceptable coating coverage level, is sufficient to exceed the 50 percent attentuation level that is sought for the presence of a film to be detected by a rapid access processor input IR sensor. On the other hand, from the AgBrCl coating coverage series it is apparent that three successive doublings of the silver coating coverage created only a very slow increase in infrared attenuation. Hence, it is apparent that a maximum acceptable 40 mg/dm$^2$ silver coverage would have been exceeded well before attenuation reached an acceptable 50 percent level.

The coatings with successively higher levels of the infrared opacifying dye show that even small increases in the levels of the dye markedly increased the percent attentuation. Thus, the deficiency of the AgBrCl emulsion in attenuating infrared radiation can be readily overcome by the addition of relatively low levels of infrared opacifying dye.

Example 4

Gelatin (32.7) was coated on a transparent poly(ethylene terephthalate) radiographic film support. The gelatin was hardened with 1 wt % bis(vinylsulfonylmethyl)ether. The gelatin contained varied amounts of infrared opacifying dye, shown in Table IV.

The transmittance of the film samples were determined by placing the unprocessed film between and in contact with an 942 nm gallium-arsenide laser and an infrared detector of the type used as a input film detector in a rapid access processor.

TABLE IV

| Dye | Coverage (mg/dm$^2$) | Percent Transmittance | Color |
|---|---|---|---|
| None | 0 | 80 | Clear |
| IROD-7 | 0.33 | 50 | Clear |
| IROD-7 | 0.66 | 35 | Clear |
| IROD-7 | 0.99 | 30 | Sl. Blue |
| IROD-1 | 0.33 | 41 | Clear |
| IROD-1 | 0.66 | 8 | Sl. Blue |
| IROD-1 | 0.99 | 4 | Blue |

Sl. = slightly (i.e., just noticeably)

From Table IV it is apparent that IROD-1 and IROD-7 were both effective in reducing infrared transmittance to levels below 50%. The blue coloration imparted by dye addition was an advantage in that it can be used to impart the desired cold image tone to a processed element. IROD-1, a preferred infrared opacifying dye, reduced transmittance to a greater degree and produced a bluer tint at lower concentrations than IROD-7.

When 942 nm radiation absorption of the coatings were measured before and after processing in a KODAK X-OMAT 480 RA™ rapid access processor as specifically described above, no significant change in absorption was measured. From this it was concluded by IROD-1 and IROD-7 both form a permanent part of the elements and are not removed to any significant extent during processing. Thus, each are capable of being detected both by input and output IR sensors associated with the processor.

Example 5

A series of elements were constructed to demonstrate the speed increases that can be realized by incorporating a thiaalkylene bis(armmonium salt) in a film of the type contemplated by the invention.

A film support similar to that of Example 2 was employed. Onto the film support was coated a gelatin layer (10.8), which in some instances contained a development accelerator candidate compound (0.55), identified in Table V.

Over the gelatin layer was coated an emulsion layer comprised of gelatin (26.9) and sulfur and gold sensitized $AgBr_{0.30}Cl_{0.70}$ (19.4) optimally spectrally sensitized with anhydro-9-ethyl-3,3'-bis(3-sulfopropyl) -4,5,4',5'-dibenzothiacarbocyanine hydroxide, sodium salt. The emulsion contained cubic silver bromochloride grains having an average ECD of 0.147 μm.

Over the emulsion layer was coated gelatin (6.5). All of the above layers were fully forehardened using 2.5 wt % bis(vinylsulfonylmethyl)ether, based on the weight of total gelatin.

The elements were identically exposed to red light using a Wratten 29™ filter, which transmits light at wavelengths longer than 600 nm. Processing was conducted using the processing cycle, developer and fixer previously described for use with Kodak X-OMAT 480 RA™, except that in this Example a Kodak X-OMAT M-6™ processor was employed. Speed was measured at a density of 1.0. Speed is reported in relative log units (0.30 log E=30 relative log units, where E represents exposure in lux-seconds).

The results are summarized in Table V.

TABLE V

| Addenda | Relative Speed |
|---|---|
| None | 194 |
| C-1 | 194 |
| C-2 | 187 |
| C-3 | 174 |
| Q-1 | 212 |
| Q-2 | 215 |
| Q-3 | 214 |

C-1 N,N'-(1,10-decylene)bis(pyridinium) chloride;
C-2 1,1'-[1,6-(2,5-dithiahexylene)]bis(carboxylic acid); and
C-3 4,4'-[1,8-(3,6-dithiaoctylene)]bis(pyridine)

It is apparent from Table V that the thiaalkylene bis (ammonium salt) compounds Q-1, Q-2 and Q-3 increase speed by approximately a half stop (0.15 log E). The comparative compound C-1, which differs from a thiaalkylene bis(ammonium salt) structure by the absence of divalent sulfur atoms, fails to produce any significant increase in speed. This demonstrates that the divalent sulfur atoms are essential components of the compounds that act as development accelerators. Similarly, comparative compound C-2, which replaces the ammonio groups with carboxy groups, also fails to produce any significant increase in speed, thereby demonstrating that the ammonio groups are also essentail to obtaining development acceleration. Finally, comparative compound C-3, which substitutes trivalent nitrogen for quaternized nitrogen, also fails to produce a significant speed increase, thereby demonstrating that quaternized nitrogen is essential to obtaining development acceleration.

Example 6

A series of elements were prepared and tested similarly as in Example 5, except that the emulsion contained cubic $AgBr_{0.30}Cl_{0.70}$ grains having a mean ECD of 0.22 μm. Further, instead of adding to a gelatin undercoat, the varied compound was added directly to the emulsion layer in the concentration shown in Table VI.

The results are summarized in Table VI.

TABLE VI

| Addenda | Relative Speed |
|---|---|
| None | 220 |
| Q-1 (0.11) | 226 |
| Q-1 (0.22) | 229 |
| Q-1 (0.44) | 232 |
| Q-2 (0.22) | 230 |
| Q-3 (0.22) | 228 |
| C-1 (0.11) | 220 |
| C-1 (0.11) | 220 |
| C-2 (0.22) | 218 |
| C-3 (0.22) | 197 |
| C-4 (0.22) | 221 |
| C-5 (0.11) | 215 |
| C-5 (0.22) | 212 |
| C-5 (0.44) | 204 |
| C-6 (0.22) | 219 |
| C-7 (0.22) | 220 |

C-4 N,N'-(1,10-decylene)bis(1-methylmorpholinium) p-toluenesulfonate;
C-5 1,10-dihydroxy-3,6-dithiaoctane;
C-6 N,N'-(1,6-hexylene)bis(trimethylammonium) chloride;
C-7 N,N'-[1,8-(3,6-disulfooctane)bispyridinium methylsulfonate;

The results shown in Table VI are consistent with the results reported in Table V. This demonstrates that the thiaalkylene bis(ammonium salt) structure is required to achieve speed enhancement. The results are confirmed at varied concentration levels, and it is demonstrated that the thialkylene bis(ammonium salt) produces similar results whether placed in the emulsion layer or a gelatin undercoat.

Example 7

Two series of films were constructed as described in Example 2, but using the emulsions of Example 2, Element E1 and Example 5. The development accelerator Q-4 was placed in the developer in the concentrations shown in Table V. Red exposures were used as described in Example 5. Processing was conducted as in Example 2, except that development time was extended to 30 seconds. Speed was again measured at a density of 1.0, as in Example 5.

The results are summarized in Table VII.

TABLE VII

| ECD (μm) | Q-4 (mg/L) | Dmin | Dmax | Relative Speed |
|---|---|---|---|---|
| 0.23 | 0 | 0.10 | 4.21 | 270 |
| 0.23 | 50 | 0.10 | 4.23 | 278 |
| 0.23 | 200 | 0.16 | 4.19 | 293 |
| 0.23 | 400 | 0.26 | 4.15 | 307 |
| 0.147 | 0 | 0.05 | 4.06 | 233 |
| 0.147 | 50 | 0.06 | 4.07 | 239 |
| 0.147 | 200 | 0.08 | 3.98 | 251 |
| 0.147 | 400 | 0.19 | 3.90 | 263 |

It is demonstrated in Table VII that a large increase in speed is provided by the thialkylene bis(ammonium salt) development accelerator with little impact on either maximum or minimum density levels.

Example 8

A series of elements were constructed to demonstrate the effect of incorporated development accelerator and/or supplemental developing agent on observed levels of speed in elements containing an incorporated developing agent.

A film support similar to that of Example 2 was employed. Onto the film support was coated an emulsion layer comprised of gelatin (32.7) and sulfur and gold sensitized $AgBr_{0.30}Cl_{0.70}$ (21.8) optimally spectrally sensitized with anhydro-9-ethyl-3,3'-bis(3-sulfopropyl)-4,5,4',5'-dibenzothiacarbocyanine hydroxide, sodium salt. The emulsion contained cubic silver bromochloride grains having an average ECD of 0.23 μm. The developing agent HQ-1 or HQ-10 was incorporated in the emulsion layer in a concentration of 0.5 equivalents (5.5 or 11.6 mg/dm$^2$, respectively). A supplemental developing agent and development accelerator incorporations were varied, as shown in Table VIII.

Over the emulsion layer was coated gelatin (6.5). All of the above layers were fully forehardened using 2.5 wt % bis(vinylsulfonylmethyl)ether, based on the weight of total gelatin.

The elements were identically exposed to red light using a Wratten 29™ filter, which transmits light at wavelengths longer than 600 nm. The elements were identically developed for 20 seconds at 35° C. using Kodak Royalprint™ activator, fixed for 30 seconds using the fixer composition previously described, and then washed in water for 2 minutes.

The results using HQ-1 are summarized in Table VIII and the results using HQ-10 are summarized in Table IX.

TABLE VIII

| SDA-18 | Q-1 | Dmin | Dmax | Relative Speed |
|---|---|---|---|---|
| 0 | 0 | 0.06 | 2.84 | 234 |
| (0.22) | 0 | 0.06 | 3.07 | 243 |
| (0.22) | (0.11) | 0.07 | 2.88 | 251 |
| (0.22) | (0.22) | 0.07 | 2.96 | 256 |
| (0.44) | 0 | 0.06 | 2.95 | 248 |
| (0.44) | (0.11) | 0.07 | 3.01 | 262 |
| (0.44) | (0.22) | 0.08 | 2.94 | 260 |

TABLE IX

| SDA-18 | Q-1 | Dmin | Dmax | Relative Speed |
|---|---|---|---|---|
| 0 | 0 | 0.06 | 1.53 | 132 |
| 0 | (0.11) | 0.06 | 1.82 | 165 |
| 0 | (0.22) | 0.06 | 2.18 | 182 |
| 0 | (0.44) | 0.06 | 2.57 | 187 |
| (0.11) | 0 | 0.06 | 2.63 | 187 |
| (0.22) | 0 | 0.06 | 3.04 | 196 |
| (0.44) | 0 | 0.06 | 3.20 | 211 |
| (0.11) | (0.11) | 0.06 | 2.88 | 206 |
| (0.11) | (0.22) | 0.06 | 3.17 | 206 |
| (0.11) | (0.44) | 0.07 | 3.36 | 223 |
| (0.22) | (0.11) | 0.06 | 3.07 | 207 |
| (0.22) | (0.22) | 0.06 | 3.17 | 219 |
| (0.22) | (0.44) | 0.06 | 3.39 | 227 |
| (0.44) | (0.11) | 0.07 | 3.27 | 210 |
| (0.44) | (0.22) | 0.08 | 3.26 | 217 |
| (0.44) | (0.44) | 0.10 | 3.48 | 236 |

From Tables VIII and IX it is apparent that each of supplemental developing agent and development accelerator are capable of enhancing speed, but the highest levels of speed are realized when both are present. All incorporation levels shown provided satisfactory imaging results.

Example 9

Exposure and processing of separate samples of the same series of elements shown in Table IX were repeated, except that instead of using an activator solution Developer A was diluted to one quarter of its original strength.

The results are summarized in Table X.

TABLE X

| SDA-18 | Q-1 | Dmin | Dmax | Relative Speed |
|---|---|---|---|---|
| 0 | 0 | 0.06 | 3.37 | 223 |
| 0 | (0.11) | 0.06 | 3.36 | 232 |
| 0 | (0.22) | 0.06 | 3.42 | 230 |
| 0 | (0.44) | 0.06 | 3.31 | 235 |
| (0.11) | 0 | 0.06 | 3.38 | 223 |
| (0.22) | 0 | 0.06 | 3.44 | 222 |
| (0.44) | 0 | 0.06 | 3.37 | 222 |
| (0.11) | (0.11) | 0.06 | 3.33 | 231 |
| (0.11) | (0.22) | 0.06 | 3.42 | 231 |
| (0.11) | (0.44) | 0.07 | 3.33 | 238 |
| (0.22) | (0.11) | 0.06 | 3.41 | 229 |
| (0.22) | (0.22) | 0.07 | 3.40 | 230 |
| (0.22) | (0.44) | 0.07 | 3.31 | 236 |
| (0.44) | (0.11) | 0.06 | 3.43 | 228 |
| (0.44) | (0.22) | 0.06 | 3.43 | 231 |
| (0.44) | (0.44) | 0.07 | 3.13 | 244 |

When a film sample lacking both Q-1 and SDA-18 were processed using the standard rapid access processing employed in Example 2, a relative speed of 223 was observed. From Table X it can be seen that the development accelerator allowed recapture of the speed lost by diluting the developer, whereas the supplemental developing agent had little impact on speed. Although the elements with higher speeds show preferred performance characteristics, all of the elements tested exhibited acceptable performance characteristics.

Example 10

The effect of incorporated developing agent on the physical properties of the film was ascertained by employing a film sample according to Example 9 containing no incorporated development accelerator or supplemental developing agent. The developing agent HQ-10 was incorporated at varied levels, as shown in Table XI.

TABLE XI

| (mg/dm$^2$) | Equivalents | Mushiness | Tackiness |
|---|---|---|---|
| 0 | 0 | 121 | 3 |
| (2.3) | 0.125 | 122 | 3 |
| (5.8) | 0.25 | 108 | 3 |
| (11.6) | 0.5 | 103 | 3 |
| (17.3) | 0.75 | 99 | 10 |
| (23.1) | 1.0 | 82 | 10 |

Tackiness was measured on an arbitrary scale where a rating of 1 indicates the film was not tacky and a rating of 10 indicates that the film blocks (adheres to another film placed in contact with it). Mushiness was measured in terms of the weight in grams applied that had to be applied to a stylus to create a gauge (plow) in the film coating. Both tackiness and mushiness were within acceptable limits when the development agent was present in a concentration of 0.5 equivalent or less.

Example 11

An element according to the invention, E17, was constructed similarly as Element E1 (see Example 2), except that the mean grain ECD was 0.26 μm, the silver coverage was 21.4 mg/dm$^2$, and the emulsion layer contained Q-1 (0.05).

A control element, E18, was constructed similarly as element E17, except that the emulsion was that employed in Element E2 (see Example 2).

Six hundred samples (each sample was a 14×17 inch, 35.6×43.2 cm, sheet) of each element were exposed and identically processed as in Example 2, but with replenishment of developer and fixer as described below.

Samples of element E18 were processed with standard replenishment of developer and fixer. That is, 60 mL of developer and 90 mL of fixer was added after each sheet was processed. The results are summarized in Table XII. Speed was measured at a density of 1.0. Dmax* is the density observed at an exposure of 1.1 log E greater than the exposure required to produce a density of 0.2 above Dmin.

TABLE XII

| Sheet Processed | Dmin | Dmax* | Speed |
|---|---|---|---|
| 1st | 0.18 | 3.75 | 293 |
| 300th | 0.19 | 3.79 | 297 |
| 600th | 0.19 | 3.73 | 296 |
| Δ(1–600) | 0.01 | −0.02 | 3 |

The comparison of Table XII was next repeated, except that the developer and fixer replenishment were each reduced to 20 mL/sheet. The results are summarized in Table XIII.

TABLE XIII

| Sheet Processed | Dmin | Dmax* | Speed |
|---|---|---|---|
| 1st | 0.18 | 3.50 | 288 |
| 300th | 0.18 | 2.84 | 282 |
| 600th | 0.18 | 2.63 | 273 |
| Δ(1–600) | 0.01 | −0.87 | −15 |

A comparison of Tables XII and XIII reveals that reduced replenishment resulted in significant loss of maximum density and speed.

The comparisons reported in Tables XII and XIII were repeated, except that sheets of element E17 were substituted for sheets of element E18. The results with replenishment rates employed in Table XII are reported in Table XIV, and the results with replenishment rates employed in Table XIII are reported in Table XV.

TABLE XIV

| Sheet Processed | Dmin | Dmax* | Speed |
|---|---|---|---|
| 1st | 0.20 | 4.10 | 295 |
| 300th | 0.20 | 4.13 | 294 |
| 600th | 0.20 | 4.08 | 294 |
| Δ(1–600) | 0.00 | −0.02 | −1 |

TABLE XV

| Sheet Processed | Dmin | Dmax* | Speed |
|---|---|---|---|
| 1st | 0.22 | 4.17 | 294 |
| 300th | 0.21 | 4.13 | 296 |
| 600th | 0.21 | 4.13 | 297 |
| 1200th | 0.21 | 4.09 | 295 |
| Δ(1–1200) | −0.01 | −0.08 | 1 |

In comparing Tables XIV and XV it is apparent that element E17 of the invention exhibited much less variance as a function of reduced replenishment than the control element E18. Further, element E17 showed less variance in performance, even when processing was extended over 1200 successive sheets of film with reduced replenishment. This demonstrates the marked improvement of the elements of the invention.

The invention has been described in detail with particular reference to preferred embodiments thereof, but it will be understood that variations and modifications can be effected within the spirit and scope of the invention.

What is claimed is:

1. A radiation-sensitive silver halide film for reproducing digitally stored medical diagnostic images through a series of laterally offset exposures by a controlled radiation source followed by processing in 90 seconds or less, including development, fixing and drying, comprised of a transparent film support having front and back major faces, a front hydrophilic colloid layer unit containing an emulsion layer coated on the front face of the support, and a back hydrophilic colloid layer unit coated on the back face of the support, wherein (A) the film exhibits an average contrast in the range of from 1.5 to 2.0, measured over a density above fog of from 0.25 to 2.0, (B) the emulsion layer (1) contains silver bromochloride grains including grain faces lying in {100} crystal planes (a) comprised of from 20 to 40 mole percent bromide, based on total silver, (b) having a mean equivalent circular diameter of less than 0.40 μm, (c) exhibiting an average aspect ratio of less than 1.3, and (d) coated at a silver coverage of less than mg/dm$^2$, and (2) has adsorbed to the surfaces of the silver bromochloride grains at least one spectral sensitizing dye having an absorption half peak bandwidth in the spectral region of exposure by the controlled radiation source, (C) the back hydrophilic colloid layer unit contains a magnetic recording layer, and (D) the film contains an infrared opacifying dye that is capable of reducing specular transmission through the film before, during and after processing to less than 50 percent, measured at a wavelength within the spectral region of from 850 to 1100 nm.

2. A film according to claim 1 wherein magnetic recording layer is comprised of hydrophilic colloid and ferromagnetic particles.

3. A film according to claim 2 wherein the ferromagnetic particles have a surface area of at least 30 m$^2$/g, are coated at coverage of from 0.1 to 10 mg/dm$^2$, and account for from 1 to 10 percent of the total weight of the magnetic recording layer.

4. A film according to claim 3 wherein the ferromagnetic particles have a surface area of at least 40 m$^2$/g.

5. A film according to claim 4 wherein the ferromagnetic particles are $\gamma$-$Fe_2O_3$ particles.

6. A film according to claim 3 wherein the ferromagnetic particles are coated at a coverage of from 0.2 to 0.7 mg/dm$^2$.

7. A film according to claim 3 wherein the ferromagnetic particles are acicular having an average major axis length of less than 0.3 μm a ratio of major axis length to thickness diameter of up to 5:1.

8. A film according to claim 1 wherein the support contains a blue dye and the b* value of the film is −6.5 or more negative.

9. A film according to claim 8 wherein the blue dye contributes less than −5.0 to the b* value of the film.

10. A film according to claim 1 wherein the silver bromochloride grains are coated at a coverage in the range of from 10 to 30 mg/dm$^2$, based on silver.

* * * * *